United States Patent [19]

Van Meurs et al.

[11] Patent Number: 4,965,493

[45] Date of Patent: Oct. 23, 1990

[54] ELECTRIC ARRANGEMENT FOR IGNITING AND SUPPLYING A GAS DISCHARGE LAMP

[75] Inventors: Johannes M. Van Meurs; Machiel A. M. Hendrix, both of Eindhoven, Netherlands

[73] Assignee: U.S. Philips Corporation, New York, N.Y.

[21] Appl. No.: 251,628

[22] Filed: Sep. 29, 1988

[30] Foreign Application Priority Data

Oct. 7, 1987 [NL] Netherlands ..... 8702383

[51] Int. Cl.[5] ..... H05B 37/02

[52] U.S. Cl. ..... 315/224; 315/240; 315/DIG. 5

[58] Field of Search ..... 315/224, 225, 240, DIG. 5

[56] References Cited

U.S. PATENT DOCUMENTS 4,525,648 6/1985 DeBijl et al. ..... 315/224

FOREIGN PATENT DOCUMENTS 2124042 2/1984 United Kingdom .

*Primary Examiner*—Robert J. Pascal

*Attorney, Agent, or Firm*—Bernard Franzblau

[57] ABSTRACT

An electric arrangement for igniting and supplying a gas discharge lamp (13) has two input terminals (1, 2) intended to be connected to an AC power supply source. The output terminals of a rectifier bridge (4, 5, 6, 7) are connected in the operative state of the lamp to a DC/AC converter having two input terminals (A, B), one terminal (A) of which is connected to the other terminal (B) at least via a series arrangement of a first semiconductor switching element (9) and a load circuit comprising at least an induction coil (10) and the discharge lamp (13) as well as a capacitor (15). The load circuit and capacitor are shunted by a circuit comprising a second semiconductor switching element (16) and a parallel arrangement of a third semiconductor switching element (18) and a diode (17). The first two semiconductor switching elements are shunted by a buffer capacitor (8). The third semiconductor switching element (18) includes a control circuit which makes the third switching element conduct for a given period at the start of each period of the high-frequency cycle of the converter.

11 Claims, 2 Drawing Sheets

ELECTRIC ARRANGEMENT FOR IGNITING AND SUPPLYING A GAS DISCHARGE LAMP

BACKGROUND OF THE INVENTION

This invention relates to an electric arrangement for igniting and supplying a gas discharge lamp, which arrangement has two input terminals for connection to an AC power supply source A, rectifier bridge connected to the AC power supply source has output terminals connected to a DC/AC converter having two input terminals, one terminal of which is connected to the other terminal at least via a series arrangement of a first semiconductor switching element and a load circuit comprising at least an induction coil and the discharge lamp as well as a capacitor. The load circuit and capacitor are shunted by a circuit comprising a second semiconductor switching element and a third semiconductor switching element, the first two semiconductor switching elements being shunted by a buffer capacitor. An arrangement of this type is known from the published British Patent Application No. 2,124,042.

This British Patent Application describes a high-frequency ballast circuit for a gas discharge lamp comprising a DC/AC converter of the half bridge or full bridge type. The circuit is designed in such a way that during operation, charge current peaks of the buffer capacitor in the mains power supply are suppressed without using special filters (such as bulky choke coils). This is possible by charging the buffer capacitor to a voltage exceeding the peak of the mains voltage.

It has been found that a reasonable suppression of the said current peaks can be realized only in a specific combination of a lamp having a given power and the associated specific values of electric components incorporated in the circuit. An adaptation of the values of the said components is necessary for operating a lamp having a different power. This is a drawback because such circuits then cannot easily be used universally for lamps having different powers.

SUMMARY OF THE INVENTION

It is an object of the invention to provide an arrangement of the type described in the opening paragraph comprising a circuit which can be universally used for lamps with different powers, or for lamps whose arc voltage varies during operation, while complying with international standards imposed with regard to mains current distortion.

To this end an arrangement according to the invention is characterized in that the third semiconductor switching element includes a control circuit rendering the third switching element conductive for a given period at the start of each period of the high-frequency cycle of the converter.

An arrangement according to the invention can be universally used for lamps of different powers. Moreover, with a lamp voltage varying during lamp operation, it was found that a mains current whose shape complied with the prevailing international standards was obtained for a desired lamp power by adapting the period of conductance of the third semiconductor switching element. A correct value of the voltage across the buffer capacitor was also realized realised. Consequently, it is not necessary to replace certain electric components by others for use in lamps of different powers. Such circuits can be manufactured in bulk quantities.

Current waveforms of a non-sinusoidal shape complying with the standards as to mains current distortion can be achieved by adjusting the period of conductance of the third semiconductor switching element. In the arrangement according to the invention, a trapezoidal mains current waveform is preferably used, creating the possibility of choosing the current through the lamp electrodes, the coil and the switching elements to be lower than in the known arrangement. The efficiency of the arrangement according to the invention is then considerably better.

The invention is based on the recognition that the energy flow through the load circuit can be controlled by rendering the third switching element conducting and non-conducting. If the switching element is non-conducting and the first semiconductor switching element is conducting, the energy comes from the mains power supply. If the element is conducting, the energy is taken from the buffer capacitor. The energy consumption from the mains is then discontinued. The period of conductance is adjusted in such a way that the energy which has been taken from the respective "sources" (buffer capacitor and mains) leads to a trapezoidal mains current.

It is to be noted that in a given embodiment described in the above-cited British Patent Application, a semiconductor switching element is also arranged parallel across a diode. However, this switching element is used to safeguard the buffer capacitor and to this end it is rendered conducting for a large number of uninterrupted high-frequency periods.

In a specific embodiment of the arrangement according to the invention, a sensor for measuring the current through the third semiconductor switching element is present, said sensor being coupled to the control circuit of the third semiconductor switching element.

A synchronization with the high-frequency voltage across the third switching element is realized by means of the current sensor. This minimizes the switching losses of the third switching element. In a practical embodiment the third semiconductor switching element is shunted by a series arrangement of the current sensor and a diode.

By measuring the intensity of the current in the circuit the third semiconductor switching element is not switched on until the voltage thereacross is zero. This not only minimizes the switch-on losses of the third switching element, but also the control circuit of the third semiconductor switching element is simple.

BRIEF DESCRIPTION OF THE DRAWINGS

The invention will now be described in greater detail, by way of example, with reference to the accompanying drawings, in which.

DESCRIPTION OF THE PREFERRED EMBODIMENTS

Figure 1:
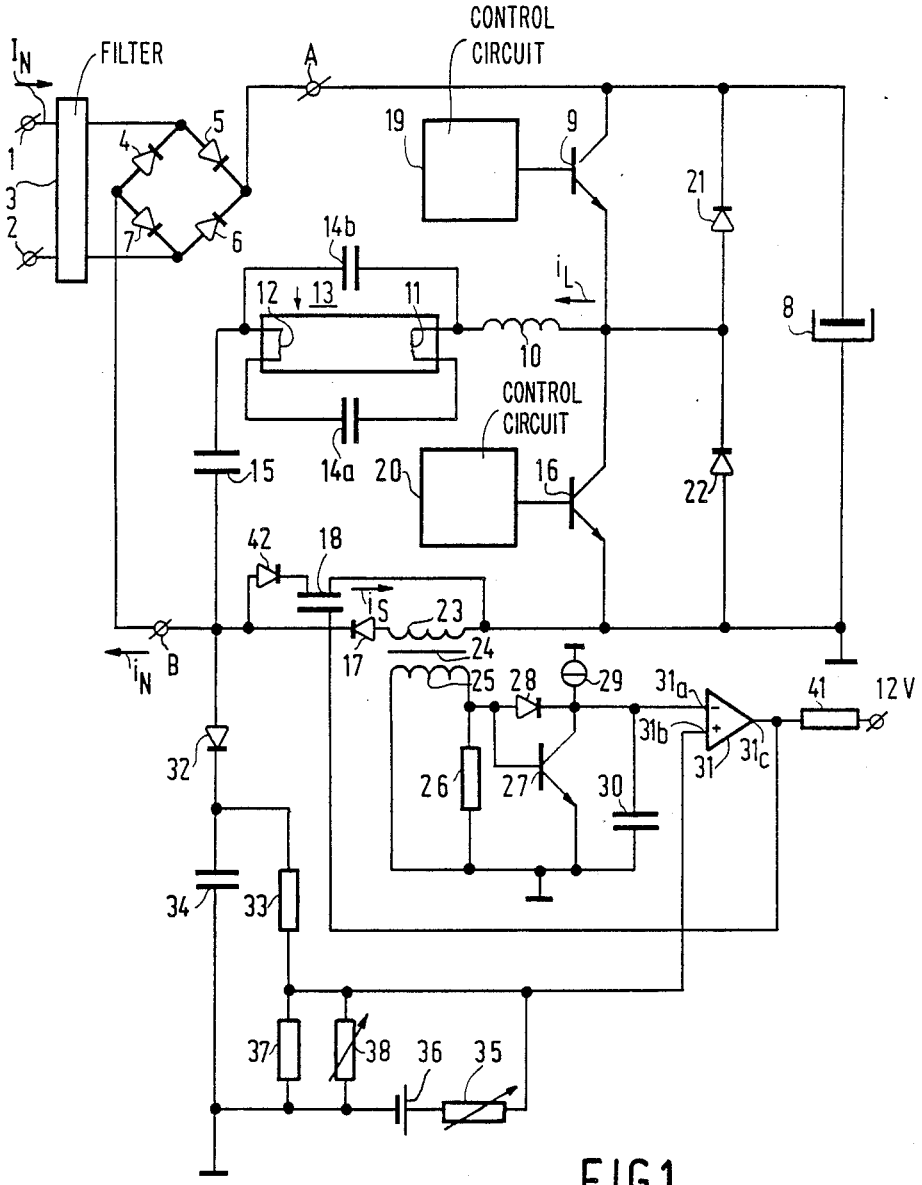
FIG. 1 shows diagrammatically an embodiment of an electric arrangement according to the invention with a discharge lamp connected thereto.

The arrangement in FIG. 1 has two input terminals 1 and 2 intended to be connected to an AC power supply source. A rectifier bridge comprising four diodes 4, 5, 6 and 7 is connected to the input terminals via an anti-interference filter 3. The outputs of the bridge are connected to the input terminals A and B of a high-frequency DC/AC converter.

The terminals A and B of the converter are connected together by means of a series arrangement comprising a first semiconductor switching element 9 and a load circuit made up of an induction coil 10, the electrodes 11 and 12 of a lamp 13 (with capacitors 14*a* and 14*b*) and the capacitor 15. The elements 10 to 15 are shunted by a circuit including a second semiconductor switching element 16 and a parallel arrangement of a diode 17 and the third semiconductor switching element 18 (in series with a diode 42). The first two semiconductor switching elements (9 and 16) are npn transistors and the third switching element is a MOS-FET. The elements 9 and 16 are shunted by a buffer capacitor 8.

The said switching elements 9 and 16 have control circuits 19 and 20 for rendering the two switching elements 9 and 16 alternately conducting. The diodes 21 and 22 are arranged in anti-parallel across these switching elements.

The control circuits 19 and 20 are only shown diagrammatically. In the said embodiment these circuits are integrated in the converter in a manner as is shown in the U.S. Pat. No. 4,525,648 (6/25/85).

The control circuit of the third semiconductor switching element 18 is shown in greater detail in FIG. 1. The element 18 is arranged in series with the diode 42. The series arrangement of diode 17 and the primary winding 23 of a transformer 24 (the current sensor for measuring the current through 17) is arranged in parallel with circuit the consisting of elements 18 and 42. A resistor 26 is arranged parallel across the secondary winding 25 of the transformer 24. A transistor 27, with a diode 28 arranged across its base-collector, is arranged parallel across the winding 25. The collector is also connected to a current source 29. Finally, a capacitor 30 is arranged parallel across the collector-emitter of the transistor 27.

One end of the winding 25 is connected via the diode 28 to an input terminal 31*a* of a comparison circuit 31. The other input terminal 31*b* of the comparison circuit 31 is connected to a dividing network generating a voltage which is modulated with the mains power supply frequency and which is derived from the voltage across buffer capacitor 8. The input terminal 31*b* is connected to terminal B of the converter via a series arrangement of a diode 32 and a resistor 33. The junction point of 32 and 33 is connected to ground via a capacitor 34. The said input terminal (31*b*) is also connected to ground via a variable resistor 35 and a DC power supply source 36. Moreover, terminal 31*b* is connected to ground via the parallel arrangement of a resistor 37 and a variable resistor 38. The output terminal 31*c* is connected to the control electrode of the third semiconductor switching element 18 and to a voltage supply source of 12 V (DC) via a resistor 41.

The arrangement described operates as follows. If an alternating voltage (220 V, 50 Hz) is applied to the terminals 1 and 2, a direct voltage will be produced between the terminals A and B. Subsequently, the two switching elements 9 and 16 are rendered alternately conducting by means of a starter circuit and a time circuit (see the above-cited U.S. Pat. No. 4,525,648).

A sawtooth generator, which is synchronized with the zero crossings of the current through diode 17, is created by means of transformer 24 and transistor 27.

If a current flows in diode 17, a voltage is generated in the secondary winding 25 of the transformed 24 so that transistor 27 is turned on and capacitor 30 is discharged. The voltage at terminal 31*a* is lower than the voltage at terminal 31*b*, with which the voltage at 31*a* is always compared. The control electrode of switching element 18 is energized via output terminal 31*c* and this element begins to conduct. If the direction of the current in the circuit is reversed (element 18 remains conducting), the current through the transformer 24 will become zero so that transistor 27 is turned off. A constant current flows through capacitor 30, resulting in the sawtooth-shaped voltage. As soon as the voltage at terminal 31*a* becomes higher than that at terminal 31*b*, the voltage at the control electrode of the switching element 18 becomes low and the switching element 18 is rendered non-conductive.

By comparing the sawtooth (by means of comparison circuit 31) with the voltage generated by means of the elements 32 to 38, the ratio of the period of conductance and the repetition cycle (duty factor) of switch 18 is influenced and the mains current is controlled.

In a concrete embodiment the most important circuit elements have the values stated in the Table below:

TABLE

| | | |
|---|---|---|
| Capacitor | 34 | 1 nF |
| Capacitor | 30 | 1 nF |
| Capacitor | 14a | 15 nF |
| Capacitor | 14b | 6.8 nF |
| Resistor | 33 | 560 kOhm |
| Resistor | 37 | 100 kOhm |
| Resistor | 38 | 100 kOhm |
| Resistor | 35 | 220 kOhm |
| Resistor | 26 | 560 Ohm |
| Resistor | 41 | 560 Ohm |
| Coil | 10 | 2 mH |
| Step-up ratio of transformer | | 1 to 10. |

Figure 2A:
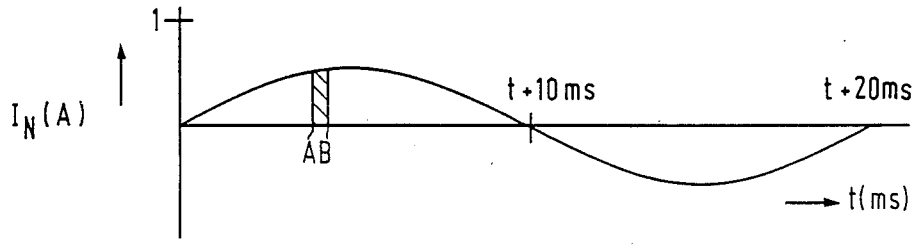
FIGS. 2*a* to 2*d* show the waveforms of the normal low-frequency mains current ($I_N$) and of the high-frequency current through the load circuit ($i_L$), the third switching element ($i_S$) and the high-frequency current ($i_N$), respectively.

FIG. 2*a* shows the mains current ($I_N$) at a frequency of 50 Hz. The time is plotted on the horizontal axis and the current is plotted on the vertical axis.

The internal state of the DC/AC converter during the time interval A–B (see FIG. 2*a*) will be explained with reference to FIGS. 2*b* to 2*d*.

Figure 2B:
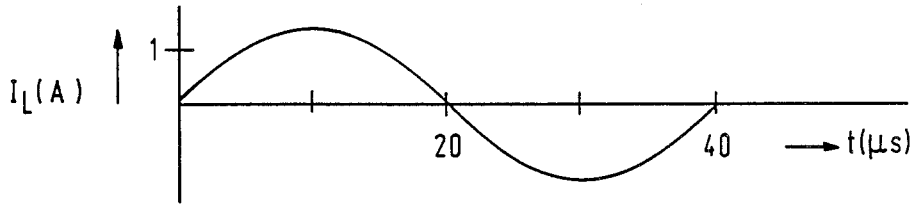

The high-frequency current $i_L$ through the coil 10 of the load circuit is shown in FIG. 2*b*. The starting point t=0 is arbitrarily chosen in the 50 Hz cycle. The waveform is substantially sinusoidal. (The high-frequency currents $i_N$, $i_S$ and $i_L$ are shown by means of arrows in FIG. 1.)

Figure 2C:
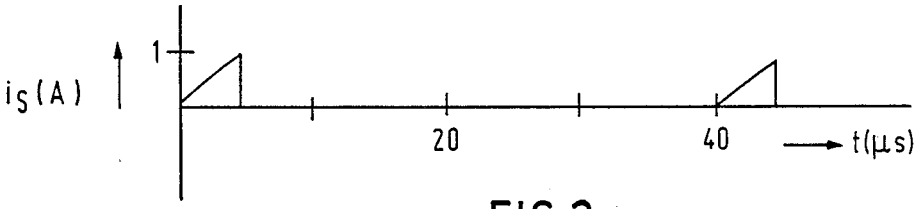

FIG. 2*c* shows the high-frequency current ($i_S$) through the third switching element 18. The element is conductive for a short time at the start of each positive high-frequency period. Subsequently, the element is non-conductive. The positive period is understood to mean the period when the current through the load circuit is positive (see direction of the arrow $i_L$). It is to be noted that the element 18 would be conductive at the start of each negative period if it were arranged in the circuit between terminal A and element 9.

Figure 2D:
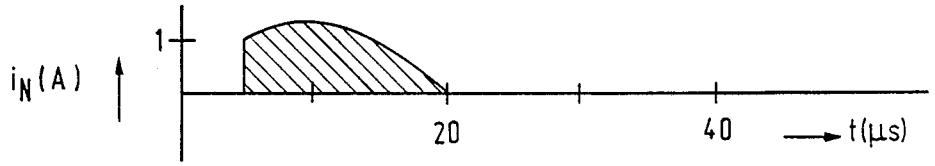

Finally, FIG. 2*d* shows the waveform of the high-frequency current ($i_N$). The area of the shaded part in FIG. 2*d* is substantially equal to the area of the shaded part of FIG. 2*a*. This is controlled by way of the period of conductance of element 18. The period of conductance is then such that the charge taken up from the buffer capacitor or the mains gives rise to a trapezoidal mains current. Such a current waveform complies with the prevailing standards.

What is claimed is:

1. An electric arrangement for igniting and supplying a gas discharge lamp comprising: two input terminals for an AC power supply source, a rectifier bridge connected to the input terminals and having output terminals connected to a DC/AC converter having two input terminals, one terminal of which is connected to the other terminal via a series arrangement of a first semiconductor switching element and a load circuit comprising at least an induction coil and the discharge lamp as well as a capacitor, said load circuit and capacitor being shunted by a circuit comprising a second semiconductor switching element and a third semiconductor switching element, the first and second semiconductor switching elements being shunted by a buffer capacitor, characterized in that the third semiconductor switching element includes a control circuit rendering the third switching element conductive for a given period at the start of each period of the high-frequency cycle of the converter.

2. An electric arrangement as claimed in claim 1, further comprising a current sensor measuring the current through the third semiconductor switching element and coupled to the control circuit of the third semiconductor switching element.

3. An electric arrangement as claimed in claim 2, wherein the third semiconductor switching element is shunted by a series arrangement of said current sensor and a diode.

4. An electric arrangement as claimed in claim 2, wherein said control circuit is responsive to said current sensor so as to control the time of conductance of the third semiconductor switching element such that the electric arrangement draws a substantially trapezoidal waveform current from said input terminals.

5. An electric arrangement as claimed in claim 2, wherein said control circuit includes a sawtooth generator synchronized to zero crossing of current flowing in said current sensor.

6. A DC/AC converter circuit for operation of an electric discharge lamp comprising:

first and second input terminals for connection to a source of DC supply voltage for the converter circuit, first, second and third controlled semiconductor switching elements connected in a first series circuit across said input terminals, a load circuit coupled to a junction point between said first and second semiconductor switching elements and further coupled to said second input terminal, said load circuit comprising a second series circuit that includes an inductor, a discharge lamp and a first capacitor a second capacitor connected in parallel across a part of the first series circuit which includes said first and second semiconductor switching elements, control circuit means coupled to control electrodes of the first and second semiconductor switching elements for triggering said switching elements alternately into conduction at a high frequency, and a control circuit coupled to a control electrode of the third semiconductor switching element for triggering the third switching element into conduction for a short time period near the start of each cycle of a high-frequency current flowing in said load circuit.

7. A DC/AC converter circuit as claimed in claim 6, further comprising a current sensor connected in the DC/AC converter circuit and coupled to the control circuit for the third semiconductor switching element so as to control the operation of the third semiconductor switching element as a function of a current through said third semiconductor switching element.

8. A DC/AC converter circuit as claimed in claim 7, further comprising a diode connected in a series arrangement with said current sensor, and means coupling said series arrangement in parallel with said third semiconductor switching element.

9. A DC/AC converter circuit as claimed in claim 7, wherein said control circuit comprises, a sawtooth generator synchronized with a current flowing in said current sensor, a comparison circuit having a first input coupled to a source of reference voltage and a second input coupled to an output of the sawtooth generator, and means coupling an output of the comparison circuit to the control electrode of the third semiconductor switching element thereby to provide said triggering of the third semiconductor switching element.

10. A DC/AC converter circuit as claimed in claim 6, further comprising first and second diodes connected in anti-parallel with said first and second semiconductor switching elements, respectively.

11. A DC/AC converter circuit as claimed in claim 6, wherein said first, second and third semiconductor switching elements are serially connected in the order named across said first and second input terminals, and said load circuit is connected between said junction point and said second input terminal.

* * * * *